US005154161A

United States Patent [19]

Rogers et al.

[11] Patent Number: 5,154,161

[45] Date of Patent: * Oct. 13, 1992

[54] AIR FILTER ASSEMBLY FOR COOKING APPARATUS

[75] Inventors: Raymond W. Rogers, Mauldin; William F. Harnesberger, Pelzer, both of S.C.

[73] Assignee: Standex International Corporation, Salem, N.H.

[ * ] Notice: The portion of the term of this patent subsequent to Nov. 12, 2008 has been disclaimed.

[21] Appl. No.: 516,255

[22] Filed: Apr. 30, 1990

Related U.S. Application Data

[63] Continuation-in-part of Ser. No. 280,025, Dec. 2, 1988, abandoned.

[51] Int. Cl.[5] ..... F24C 15/20

[52] U.S. Cl. ..... 126/299 D; 126/299 R; 55/126; 55/316; 55/DIG. 36; 99/337; 99/403; 169/65

[58] Field of Search ..... 99/337, 403, 408; 55/124, 126, 316, DIG. 36; 126/299 R, 299 D; 169/65

[56] References Cited

U.S. PATENT DOCUMENTS

| | | | |
|---|---|---|---|
| 2,868,108 | 1/1959 | Petersen | 126/299 D |
| 2,886,124 | 5/1959 | Scharmer | 55/DIG. 36 |
| 3,323,439 | 6/1967 | Weaver et al. | 126/299 D |
| 3,500,740 | 3/1970 | Aubrey | 126/299 D |
| 3,747,301 | 7/1973 | Glover et al. | 126/299 D |
| 3,785,124 | 1/1974 | Gaylord | 55/DIG. 36 |
| 3,854,388 | 12/1974 | King | 55/126 |
| 4,040,042 | 8/1977 | Mayer | 126/299 D |
| 4,155,348 | 5/1979 | Ahlrich | 126/299 D |
| 4,231,769 | 11/1980 | Ahlrich | 55/DIG. 36 |
| 4,854,949 | 8/1989 | Giler, Sr. et al. | 126/299 D |
| 4,902,316 | 2/1990 | Giles, Sr. et al. | 126/299 D |

FOREIGN PATENT DOCUMENTS

| | | | |
|---|---|---|---|
| 1297543 | 5/1962 | France | 126/299 D |
| 947411 | 1/1964 | United Kingdom | 55/126 |

*Primary Examiner*—Philip R. Coe
*Assistant Examiner*—Mark Spisich
*Attorney, Agent, or Firm*—Dominik, Stein, Saccocio, Reese, Colitz & VanDerWall

[57] ABSTRACT

An air filter is provided for a food cooking apparatus to avoid the necessity for venting same within a building and permitting the use of a free standing independently movable structure capable of receiving a movable cooking apparatus or accommodating a fixed cooking apparatus such as a grill.

An air filter assembly for filtering exhaust air from cooking devices is illustrated as having filter elements in vertically aligned stacked relation accessibly positioned in an imperforate housing.

1 Claim, 6 Drawing Sheets

AIR FILTER ASSEMBLY FOR COOKING APPARATUS

This Application is a Continuation-in-Part of application Ser. No. 07/280,025, filed Dec. 2, 1988, abandoned.

BACKGROUND OF THE INVENTION

Air filters employing various filtering mechanisms have been used in connection with food cooking apparatus. In the case of portable cooking apparatus such as pressure fryers and the like, such filters have been mounted in fixed position upon the cooking apparatus. Fixed hoods have been provided over various cooking apparatus as an alternative to venting and have included a variety of filters including electrostatic filters such as contemplated for use in the hood of the present invention.

In many locations including convenience stores it is desirable to provide a movable filter for use with movable cooking apparatus as an alternative to venting. The prior art is further exemplified by U.S. Pat. Nos. 3,747,301, 4,143,646, 4,155,348, 4,489,647, 4,505,194, 4,520,717 and 4,539,898 which illustrate the use of a variety of filters as an integral part of cooking apparatus. U.S. Pat. No. 4,854,949 illustrates a filter which is inclined rearwardly downwardly having a fan positioned to draw air laterally with resistance caused by the circuitous lateral air flow path.

Accordingly, it is an important object of the present invention to provide a support for carrying a hood above a cooking apparatus as well as a base for providing stability to the hood and filter carried thereby.

Another important object of the invention is the provision of a free standing air filter for use above a variety of cooking apparatus for avoiding the necessity of venting same within a store location.

Another important object of the present invention is to provide a separate movable hood for use with a portable cooking apparatus such as a deep fat fryer.

Another object of the invention is to provide a hood for use with cooking apparatus for carrying fire extinguishing apparatus independently of the cooker.

Still another object of the invention is the provision of a movable hood having a fan for creating air flow through a filter carried in the hood and returning filtered air to a building.

Filter elements are in vertically aligned stacked relation accessibly positioned in an imperforate housing.

Accordingly, it is an important object of this invention to enhance the air flow characteristics making a more effective simplified filter assembly with reduced parts.

SUMMARY OF THE INVENTION

It has been found that a free standing air filter may be provided for use within a building to avoid the venting of cooking apparatus wherein a support structure is provided for carrying a hood above the cooking apparatus straddling the cooking apparatus during use. The hood contains an air filter and structure including a fan for controlling the air flow through the filter and returning same into the building. The support structure is carried by a base which is open at one end for receiving a movable cooking apparatus within an area beneath the hood.

Preferably an electrostatic ionizer precipitator is used in connection with the filter in the structure constructed in accordance with the present invention.

A fire extinguisher is utilized by suitable positioning of apparatus for actuation and is automatic upon the occurrence of elevated temperatures, and nozzles are provided for directing fire extinguishing medium against the cooking apparatus as well as the filter within the hood. The fire extinguisher is carried by the free standing filter separate from the cooking apparatus.

It is important to note that an air filter assembly for filtering exhaust air from cooking devices is provided having filter elements in vertically aligned stacked relation accessibly positioned in an imperforate housing.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
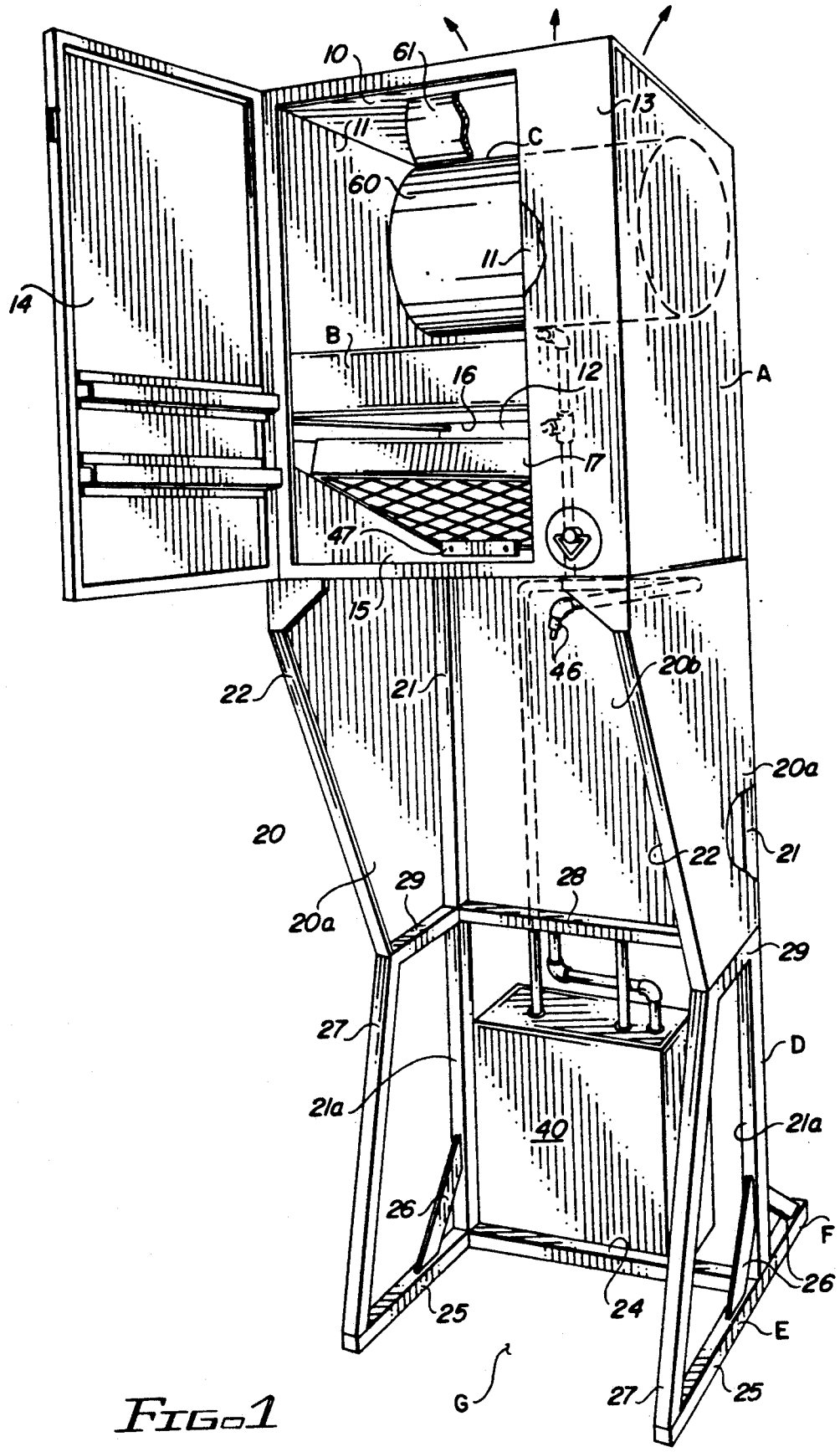
FIG. 1 is a perspective view illustrating an air filter carried in a hood having a support and base structure constructed in accordance with the present invention for accommodating an independently movable cooking apparatus.

The drawings illustrate apparatus for filtering air from a food cooking apparatus utilized within a building. A hood A extends over a cooking apparatus for receiving heated air containing contaminants flowing upwardly therefrom during a cooking operation. An air filter B is positioned within the hood removing contaminants from the heated air. The hood has an opening C therein for returning heated air into the building after the contaminants have been removed. A support structure D is provided for carrying the hood above the cooking apparatus straddling the cooking apparatus. A base E carries the support structure and hood for movement within the building. The base includes a rearward extension F carrying and affording stability for the support structure and the hood independently of the cooking apparatus. A receiving area G is defined by the support structure and the base for accommodating the cooking apparatus for positioning beneath the hood and affording access to the cooking apparatus during a cooking operation. Thus, a free standing air filter is provided avoiding a necessity for fixed vents for cooking apparatus within a building.

The hood A is generally rectangular and includes a top 10, opposed sides 11 and a rear wall 12. An instrument panel is included in the compartment 13 formed on one side of the hood. A hinged door 14 acts as a closure for the hood which is open at the bottom as at 15.

An air filter B illustrated in the form of a precipitator electrostatic ionizer extends across the hood above a suitable pre-filter element illustrated at 16. Beneath the pre-filter element 16 a filter 17 inclines downwardly rearwardly. Such inclined filters are known generally in the trade as flame guard protectors and act to drain grease downwardly and to the rear. The grease collects from contaminated air including grease laden vapors which may include steam and smoke ascending into the hood from the cooker. Such contaminated air is circulated upwardly into the hood by a fan and passed outwardly through an opening C in the top 10 of the hood. The contaminated air flows upwardly from the filter 17, through the pre-filter 16 and into the precipitator electrostatic ionizer B.

The hood A is illustrated as including a downward extension broadly designated at 20 which includes downwardly tapering side panels 20*a* and a back panel 20*b* which is a downward extension of the rear wall 12. The downward extension of the hood includes structural sections which extend downwardly as at 21 from each of the rear corners of the hood. Downwardly and inwardly inclined structural members 22 form an upper portion of the receiving area G for accommodating the food cooking device to be inserted beneath the hood. The support structure D further includes a lower portion formed by extensions 21*a* of the structural members 21 and such are bridged at the lower end by the structural members 24 which join together with the longitudinally spaced aligned structural members 25 to make up the base E and its rearward extension F. Suitable braces 26 are provided to join the base members with the support structure D. The hood support D further includes forward members which extend downwardly and forwardly as at 27. These members 27, together with the members 22, form the frame for the receiving area G. The support structure D includes at a mid-section thereof a rear horizontal support 28 as well as lower side supports 29. The upright structural members 21, 21*a*, 22, 27 and horizontal supports form spaced standards which straddle the cooker and support the hood.

Figure 3:
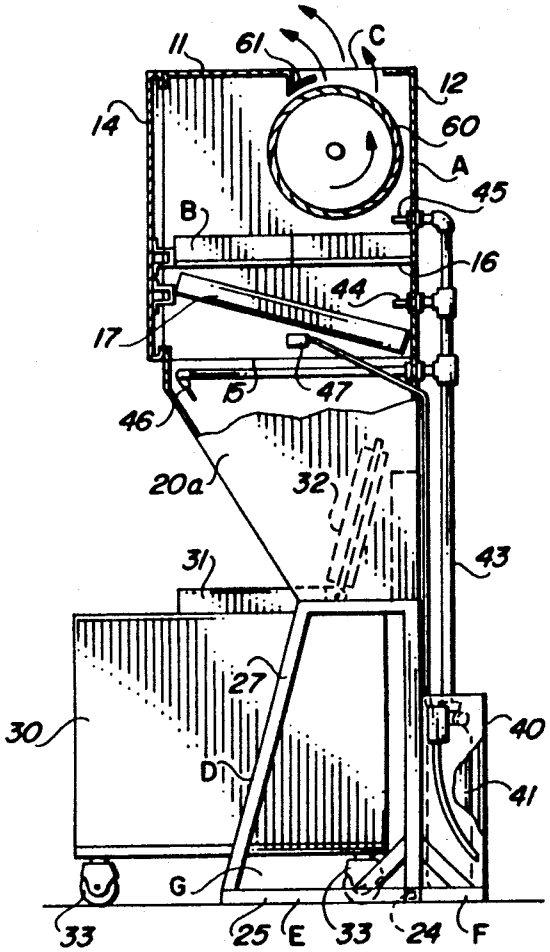
FIG. 3 is a side elevation of the apparatus constructed in accordance with the invention, with parts broken away, illustrating a cooking apparatus in the form of a deep fat pressure fryer positioned therein.
Figure 5:
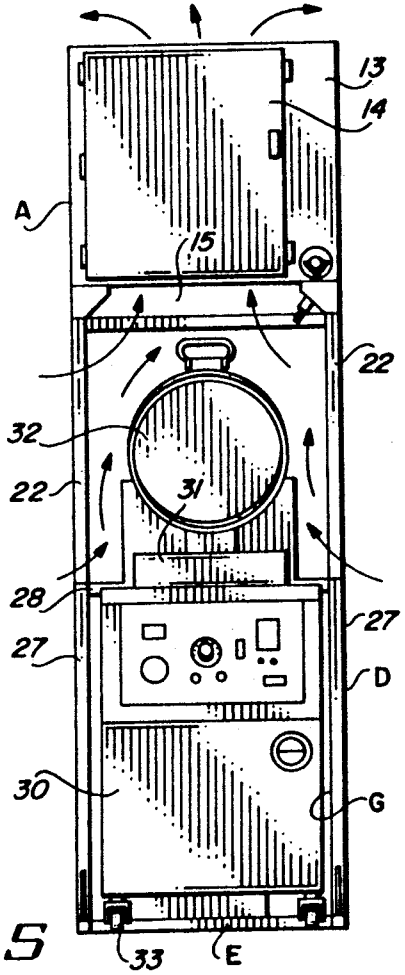
FIG. 5 is a front elevation further illustrating the apparatus constructed in accordance with the present invention with a cooking apparatus positioned therein.
Figure 4:
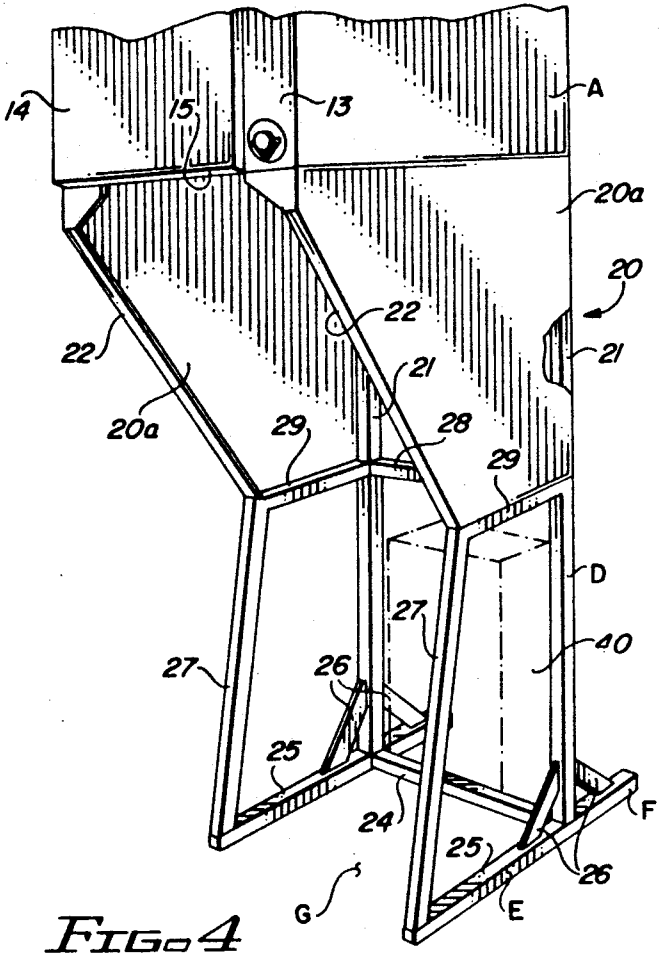
FIG. 4 is an enlarged perspective view further illustrating the hood support and base.

Referring more particularly to FIGS. 3 and 5, a cooking device in the form of a deep fat pressure fryer is illustrated at 30 and includes a cooking vessel 31 and a pressure cover 32. The movable cooking device is illustrated as being carried upon casters 33 to render same readily portable within a location such as a convenience store.

Figure 2:
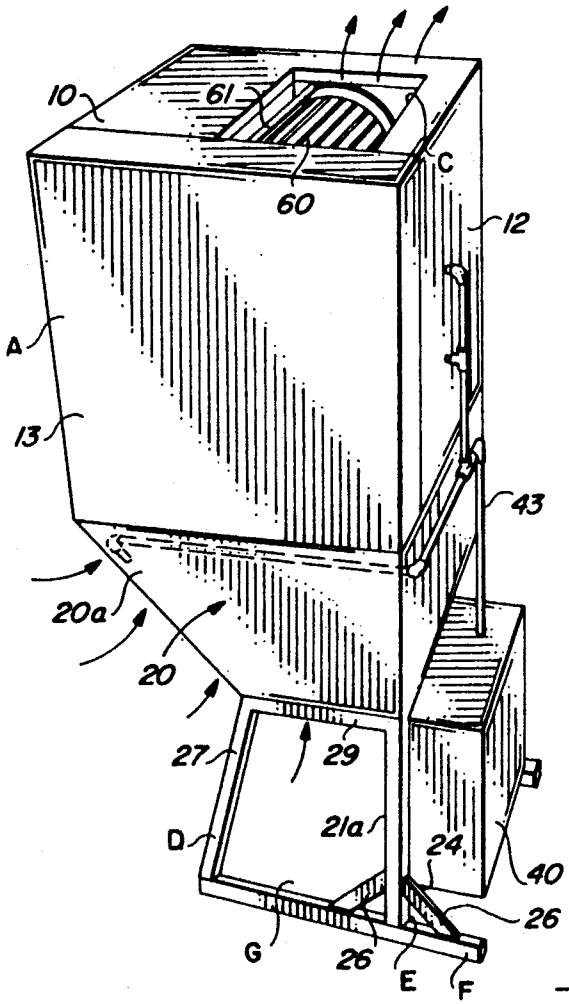
FIG. 2 is a perspective view looking from above the rear right hand corner of the apparatus shown in FIG. 1.

Referring more particularly to FIGS. 1, 2 and 3, fire extinguishing apparatus is carried within a rectangular box 40 positioned rearwardly of the bridging member 24 upon the rearward extension F of the base. The extinguishing apparatus includes a fire extinguisher 41 (FIG. 3) and a pipe which extends upwardly as at 43 to supply fire extinguishing material such as foam to the nozzle 44 which extends between the flame guard protector 17 and the electrostatic filter B. A nozzle 45 carried within the hood above the electrostatic filter B, and a nozzle 46 carried above the cooker are also supplied with foam. A fusible link is illustrated at 47 for actuating the fire extinguishing mechanism responsive to excessive temperatures as would be caused by a grease fire.

The circulation of air within the hood is produced as a result of the action of an impeller fan 60 which draws air containing grease laden vapors or other contaminated air from the cooking apparatus upwardly through the open lower portion 15 of the hood A. The contaminated air is contained within the lower extension of the hood prior to its passing through the opening 15 into a rectangular upper portion of the hood passing through the flame guard protector 17 and pre-filter 16 and thence through the precipitator B. The centrifugal fan has a baffle 61 leading to the opening C in the top 10 of the hood.

Figure 6:
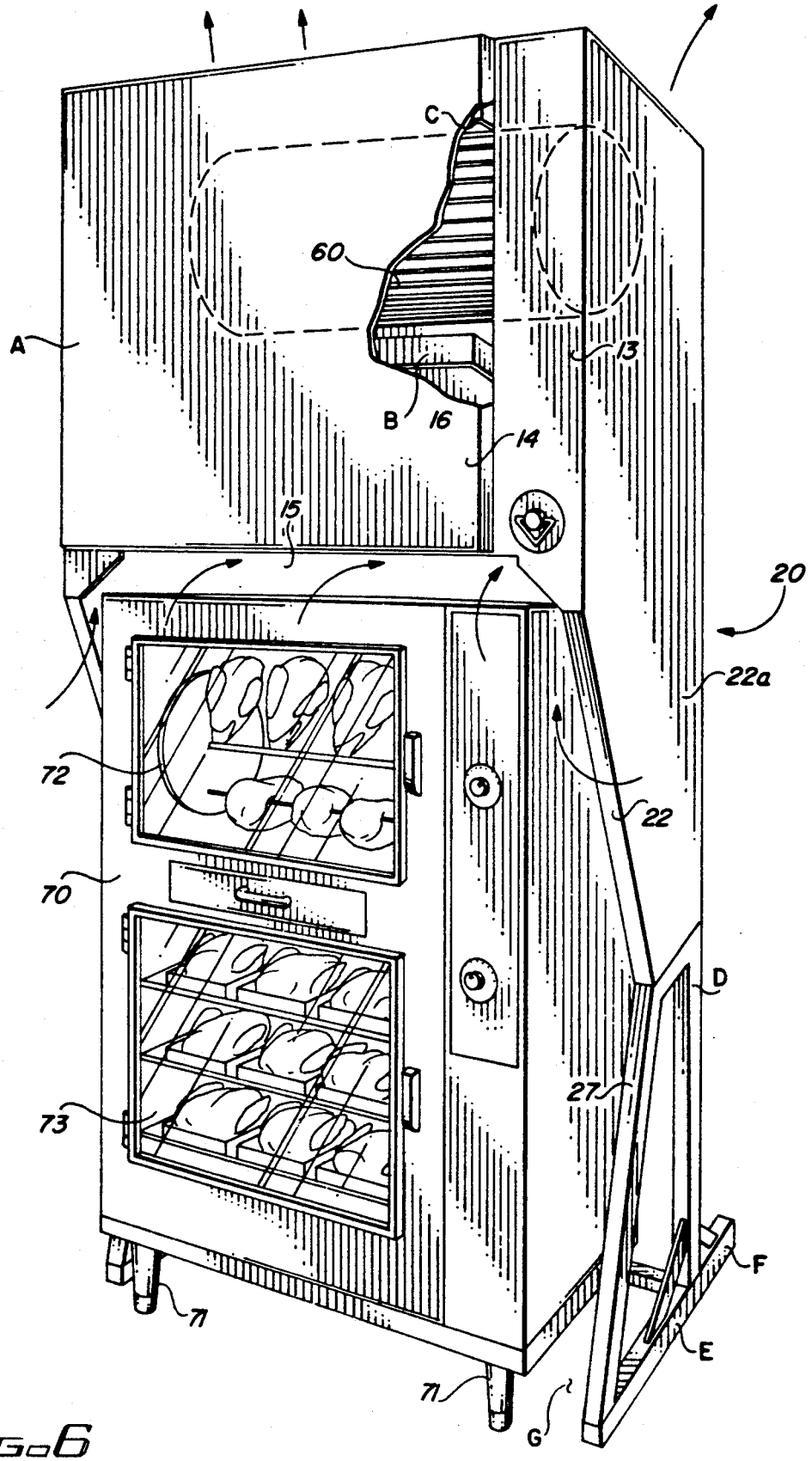
FIG. 6 is a perspective view illustrating a modified form of the invention.

FIG. 6 illustrates a modified form of the invention in that the spacing of the side frame members forming the support structure has been increased to straddle a larger cooking apparatus such as a barbecue machine 70. The barbecue machine is movable and is carried upon legs 71. The barbecue machine is contained within a receiving area G defined by the frame members 22 and 27. The barbecue machine is illustrated as having a rotisserie 72 in an upper compartment and a lower compartment 73 for warming the food.

Contaminated air passes upwardly in the direction of across and through the lower opening 15 in the hood and through the filter element which includes the electrostatic filter B responsive to the action of the fan 60. The air which has been filtered passes upwardly through opening C into the building.

It is thus seen that a filter has been provided in the form of a free standing hood. The hood is carried upon a support having an opening at one end provided by side frame members and an open base which defines a receiving area for a heating element. The hood is stably supported for movement within a store location and, due to the base and support structure, will not tip over either toward the front or rear. This arrangement provides greater versatility in locations such as convenience stores where due to changing space requirements cooking apparatus may be moved about from time to time.

The air filter is positionable above a suitable cooking apparatus for receiving exhaust air. An upright enclosed housing A is constructed of imperforate sheet material and extends across the cooking apparatus such as the deep fat pressure frier of FIG. 3. A suitable grease filter such as a flame guard manufactured by Flame Gard, Inc. of 6825 E. Washington Blvd., Los Angeles, Calif. 90040–1997 is illustrated in FIGS. 1 and 3 and in FIG. 7 and 8 at 80 forms a bottom of said housing permitting passage of exhaust air therethrough. A support 81 within the housing carries the flame guard 80 at a predetermined critical angle extending downwardly from front to rear. The critical angle is recommended by the manufacturer for best operation in this case is illustrated as at 45°. An electrostatic precipitator extends substantially horizontally in a horizontal frame 81*a*, spaced in vertical alignment above the flame guard. A fan is carried in superposed vertical aligned relation above the electrostatic precipitator. An air discharge opening C is in the housing above the fan. Thus, exhaust air is received in the flame guard and carried upward therethrough and thence vertically through the electrostatic precipitator responsive to the fan.

Figure 7:
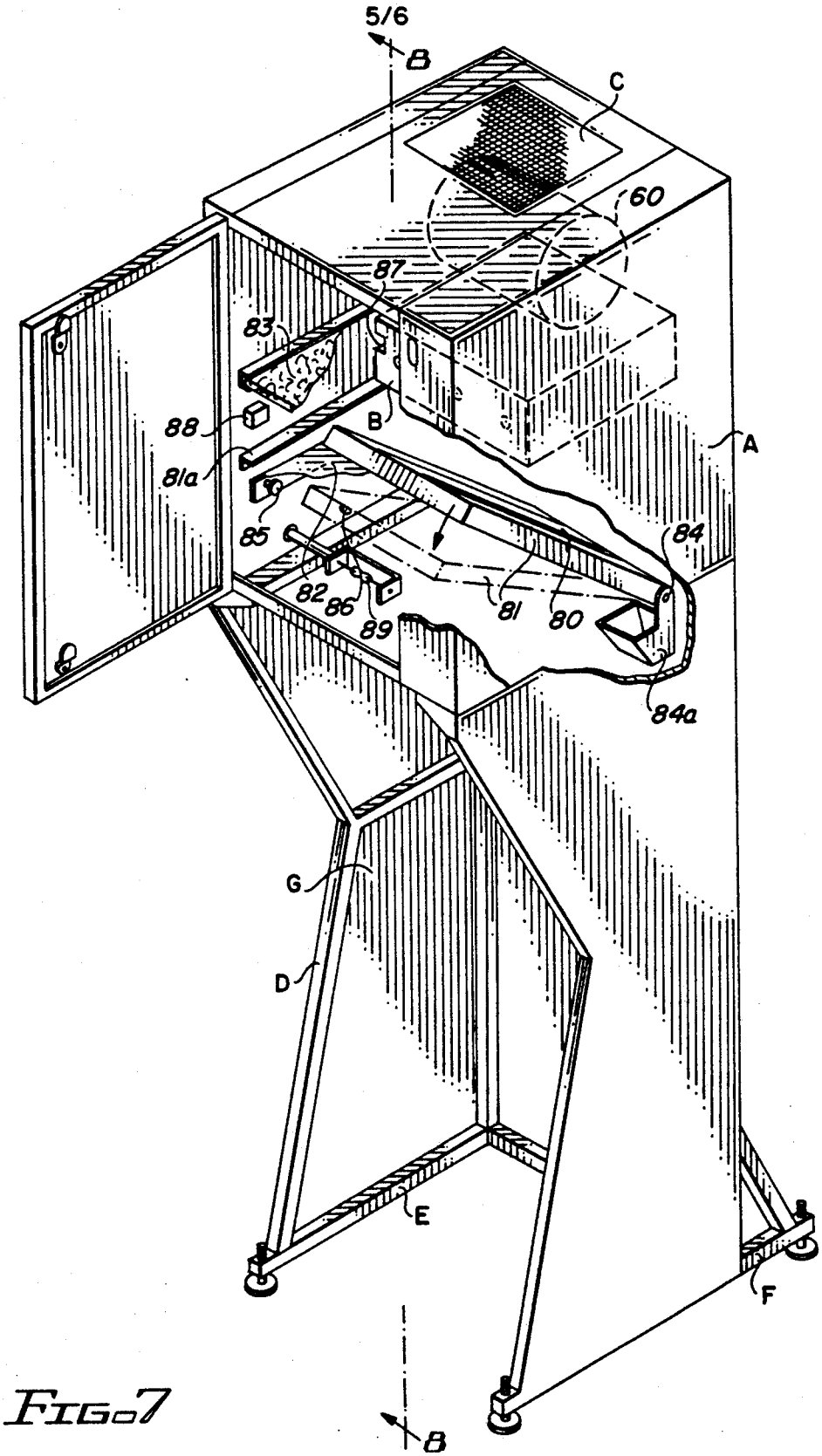
FIG. 7 is a perspective view illustrating still another modified form of the invention.
Figure 8:
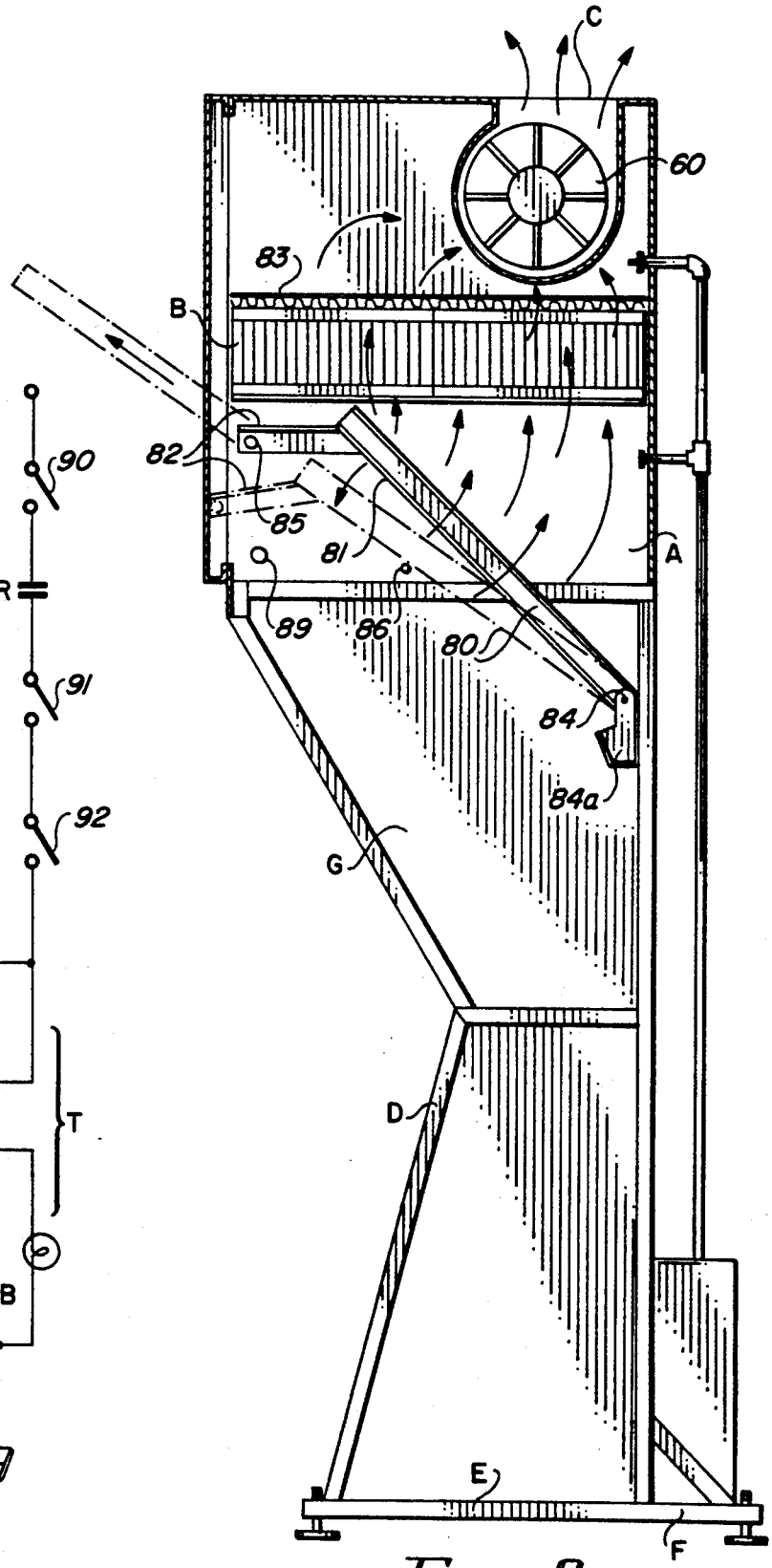
FIG. 8 is a sectional elevation taken on the line 8—8 in FIG. 7.

A further modified form of the invention illustrated in FIGS. 7 and 8 includes an imperforate sheet member 82 extending forwardly of a forward upper edge of the flame guard and side members forming a receptacle for receiving exhaust air for passage into the filter. A charcoal filter 83 is preferably disposed horizontally between the electrostatic precipitator and the fan. The support frame 81 carries the flame guard and is pivotal adjacent a rear edge thereof at 84, and a releasable fastener 85 adjacent a forward upper edge of the support frame is provided fastening the flame guard in raised operating position and in a lowered position against a stop 86 for servicing said flame guard. A keyway 87 (FIG. 7) is provided in the electrostatic precipitator receiving a key 88 carried by the housing positioning the electrostatic filter. A cup 84*a* for collecting moisture is also pivotally carried at 84.

The fan 60 positioned above the electrostatic precipitator circulates exhaust in through the flame guard, the electrostatic precipitator and discharges same from the housing. Thus, the guard, electrostatic filter and said fan are in vertically stacked aligned relation providing enhanced air flow with improved filtering action.

Figure 9:
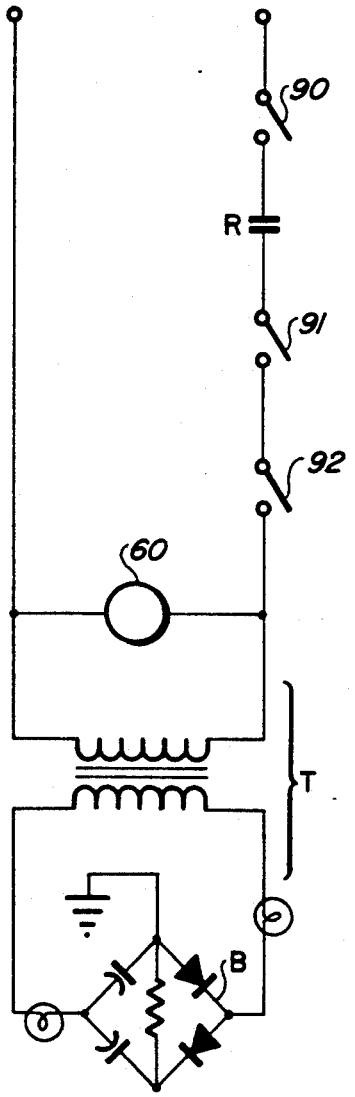
FIG. 9 is a circuit diagram illustrating operation of the components of the filter assembly including fan.

Power may be provided to the deep fat fryer which energizes the electrostatic precipitator provided the switches 90, 91 and 92 for cooking, flow and door respectively of FIG. 9 are closed. The fan blower then forces the exhaust through the filter apparatus across the precipitator B. While the filters are neutralizing the grease, a suitable signal light may flicker. If the door is opened, or flow is interrupted, or a fire starts and melts the fusible link 89 activating the extinguisher, the filter apparatus and the fryer heater circuit will open.

While a preferred embodiment of the invention has been described using specific terms, such description is for illustrative purposes only, and it is to be understood that changes and variations may be made without departing from the spirit or scope of the following claims.

What is claimed is:

1. Apparatus for filtering air from a food cooking apparatus utilized within a building comprising:

a hood extending over said cooking apparatus for receiving heated air containing contaminants flowing upwardly therefrom during a cooking operation;

an air filtering system within said hood for removing said contaminants from said heated air, said air filter system including a grease filter and, spaced thereabove, an air filter, said hood also having an opening therein for returning said heated air into said building after said contaminants have been removed;

a support structure for carrying said hood above said cooking apparatus straddling said cooking apparatus, said support structure including a base with spaced forwardly extending horizontal supports between which the cooking apparatus may be positioned and spaced rearwardly extending horizontal supports;

a fire extinguisher mounted and extending between the rearwardly extending supports at the base providing a counterbalancing of the weight of the hood on the opposite side of the vertical support and adding stability to the apparatus; and a first fire extinguisher nozzle located between the grease filter and cooking apparatus, a second fire extinguisher nozzle located between the grease filter and the air filter and a third nozzle located above the air filter with piping coupling the first, second and third nozzles to the fire extinguisher.

* * * * *